US005158824A

United States Patent [19]

Gill et al.

[11] Patent Number: 5,158,824

[45] Date of Patent: Oct. 27, 1992

[54] NON-WOVEN FIBROUS GLASS MAT AND A METHOD AND APPARATUS FOR EFFICIENTLY PRODUCING SAME

[75] Inventors: Frederick A. Gill, Littleton, Colo.; Paul R. Van Gunten, Waterville, Ohio; Glenda B. Bennett, Whitehouse, Ohio; Paul R. Swartz, Perrysburg, Ohio; Stephen Z. Bodnar, Whitehouse, Ohio

[73] Assignee: Manville Corporation, Denver, Colo.

[21] Appl. No.: 419,282

[22] Filed: Oct. 10, 1989

[51] Int. Cl.[5] ..... B32B 3/00; B32B 5/00

[52] U.S. Cl. ..... 428/284; 428/225; 428/226; 428/288; 428/297; 156/62.2; 156/295; 156/296; 162/109; 162/116; 162/141; 162/129; 162/130; 162/131; 162/132

[58] Field of Search ..... 156/295, 296, 62.2; 428/297, 284, 288, 224, 225, 226; 162/109, 116, 141, 129-132

[56] References Cited

U.S. PATENT DOCUMENTS

| | | | |
|---|---|---|---|
| 4,070,235 | 1/1978 | Marshall | 162/116 |
| 4,647,492 | 3/1987 | Grant et al. | 428/297 |
| 4,937,032 | 6/1990 | Krone et al. | 156/62.2 |

*Primary Examiner*—Patrick J. Ryan
*Assistant Examiner*—Richard C. Weisberger
*Attorney, Agent, or Firm*—Cornelius P. Quinn

[57] ABSTRACT

A non-woven fibrous mat of generally random fiber orientation with built up lines or strips of fiber formed therein directionally oriented to enhance the strength and/or appearance of a mat and a method and apparatus for efficiently producing the same by differentially controlling dewatering in a wet mat process.

5 Claims, 3 Drawing Sheets

NON-WOVEN FIBROUS GLASS MAT AND A METHOD AND APPARATUS FOR EFFICIENTLY PRODUCING SAME

BACKGROUND OF THE INVENTION

This invention relates to a non-woven fibrous mat, and more particularly to a non-woven fibrous mat manufactured from a wet mat process. In such a process staple and nonstaple glass fibers, natural fibers or synthetic fibers, or blends of these fibers dispersed in chemically treated water are transferred to the forming section or headbox of a wet mat machine and applied to a continuous moving forming belt traveling through the forming section or headbox of the wet mat machine by the flow of liquid from the headbox through the continuous moving forming belt. The flow of the liquid is controlled by means such as a vacuum applied from vacuum boxes located beneath the continuous traveling forming belt which causes the liquid to flow from the headbox and through the forming belt, and the dispersed fibers to be deposited onto the top of the continuous traveling forming belt forming a continuous nonwoven web of fibers thereon. After leaving the headbox, the continuous non-woven web of fibers is conveyed onto a moving belt and transported to a binder applicator where binder is applied and the continuous nonwoven web of fibers is transported to a drying oven to dry the binder.

More specifically, this invention relates to a nonwoven fibrous glass mat of generally random fiber orientation having formed therein some fibers oriented in specific directions and in specific patterns for the purpose of enhancing both the appearance and the strength of the mat.

In addition, this invention relates to a method and apparatus for manufacturing a non-woven fibrous glass mat having the properties and characteristics of the mat described above.

Prior to the present invention, all of the fiber in a non-woven glass fiber mat produced in the manner described above was oriented in a random fashion and a woven scrim fabric was often laminated onto the mat to enhance its appearance and strength.

It is an object of the present invention to provide a non-woven fibrous glass mat of the type produced from a wet mat process described above in which some of the fiber forming the mat is formed in specific configurations to enhance the strength and appearance of the mat.

It is a further object of the present invention to provide methods and apparatus for efficiently producing the mat described above.

SUMMARY OF THE INVENTION

The present invention is based on the discovery that the most efficient manner in which to enhance the appearance or strength of a non-woven fibrous mat is to form portions of the mat wherein the fiber contained therein is built up and oriented in a particular direction, so as to provide reinforcement and enhanced appearance therefor. This discovery is coupled with the further discovery that by differentially controlling the flow of the liquid through various areas of a continuous traveling forming belt in a wet mat process, one can control the thickness and orientation of the fibers of the continuous non-woven web belt.

The objects and advantages of the present invention will be best understood from the following description of the invention when read in conjunction with the accompanying drawings.

DESCRIPTION OF THE INVENTION

Figure 1:
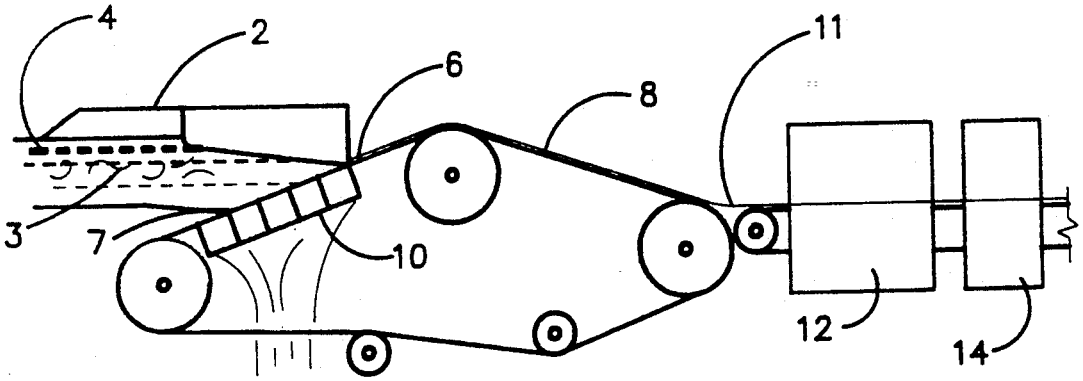
FIG. 1 is a diagrammatic view of a wet mat forming machine illustrating the forming section or headbox containing fibers dispersed in chemically treated water, the vacuum boxes and a continuous traveling forming belt on which fiber is deposited to form a continuous non-woven web of fiber for producing a non-woven fibrous mat.

Referring to the drawings, in FIG. 1 there is illustrated a forming section or headbox, generally identified by the reference numeral 2, of an apparatus known as a wet process non-woven fibrous mat making machine. As shown in the drawing, glass or synthetic fibers, or blends of glass and synthetic fibers 3 dispersed in chemically treated water 4, are transferred to the forming section or headbox 2. In the forming section 2 a continuous traveling or moving forming belt 8 passes through the dewatering headbox or forming section 2. A vacuum applied by a series of vacuum boxes 10 located beneath the traveling forming belt 8 removes the water from the dewatering area 7 of the headbox 2 through the continuous traveling forming belt 8 and the dispersed fibers 3 are deposited onto the continuous traveling forming belt 8 forming a continuous fibrous web 6 thereon. After leaving the headbox 2 the fibrous web is conveyed on a moving belt and transported to a binder applicator 12 and then to a drying oven 14 to dry the binder.

The fiber orientation of the wet-laid non-woven mat produced by this process is random resulting at times in a mat having less than desirable tensile strength.

However, in the present invention this deficiency is overcome by producing a mat with greatly increased tensile strength. This is achieved by forming portions of the mat wherein the fiber contained therein is built up and oriented in specific directions.

Figure 2:
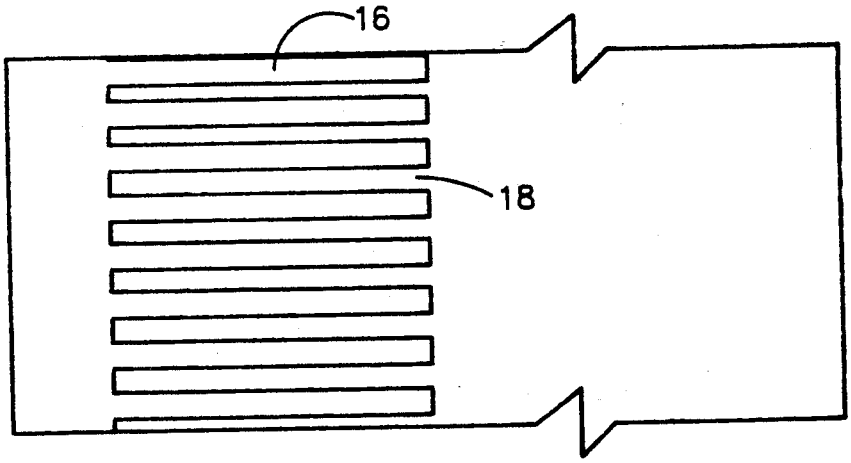
FIG. 2 is a top view of the forming section or headbox of a wet mat forming machine of the type illustrated in FIG. showing the presence of a flat slotted sheet positioned in and fastened in a portion of the dewatering area of the forming section or headbox in accordance with an embodiment of the present invention.
Figure 3:
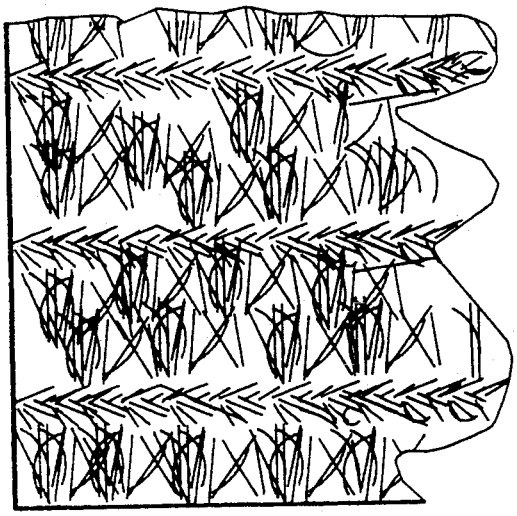
FIG. 3 is a top view of a segment of a non-woven fibrous mat produced in accordance with the embodiment of the present invention illustrated in FIG. 2.showing parallel built up lines or strips of fiber reinforcement or texture oriented in the same direction as the direction of movement of the continuous traveling forming belt.

As illustrated in FIG. 2 a flat water resistant sheet 16 is fastened to the headbox 2 covering a portion of the dewatering area. The sheet 16 has a number of longitudinal slots formed therein and is positioned in close proximity to the continuous traveling forming belt 8 as it passes through the headbox 2. As a result of the continuous forward movement of the traveling forming belt 8 as the vacuum from the vacuum boxes 10 is applied to the bottom of the continuous traveling forming belt 8 drawing the water from the headbox 2 through the continuous traveling forming belt 8, the dispersed fibers 3 are deposited through the slots 18 of the flat slotted sheet 16 on the top of the continuous traveling forming belt 8 and oriented to the shape and size of the slots 18. Since the continuous traveling forming belt 8 is in continuous movement the fibers deposited within the slotted areas 18 of the sheet 16 are oriented in the direction of travel of the continuous traveling forming belt 8. The fibers deposited in the dewatering area 7 of the forming section or headbox 2 not affected by the sheet 16 are deposited on the continuous traveling belt 8 in a random manner. The net effect on the non-woven fibrous mat produced from the embodiment of the invention shown in FIG. 2 is, as illustrated in FIG. 3, the appearance of built up lines or strips of fiber reinforcement 22 in the non-woven fibrous mat 20 oriented in the same direction as the direction of movement of the continuous traveling forming belt 8. The strengthening effect to the non-woven fiber mat 20 in the machine direction is dictated by the design of the slots 18, that is the width of the slots, the thickness of the slotted sheet 16, and the spacing of the slots over a given surface area. The thicker the slotted sheet 16, the thicker the built up lines or strips of fiber reinforcement 22 will be.

Figure 4:
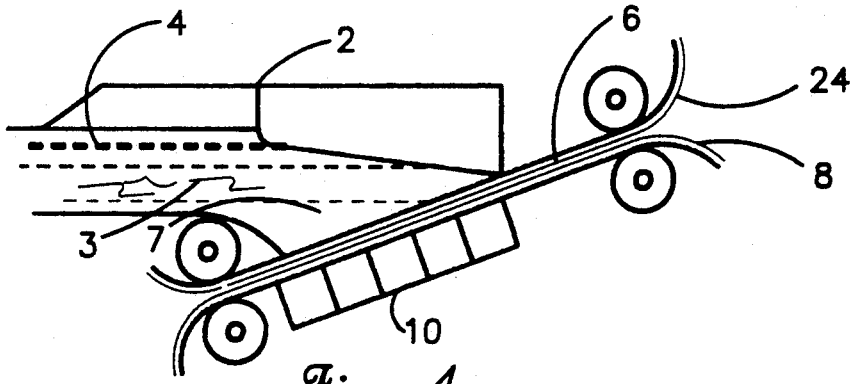
FIG. 4 is a diagrammatic view of the forming section or headbox of a wet mat forming machine and its dewatering area modified by the inclusion of an additional traveling belt adapted to move along with the traveling forming belt through the dewatering area or section of the headbox in accordance with another embodiment of the present invention.
Figure 5:
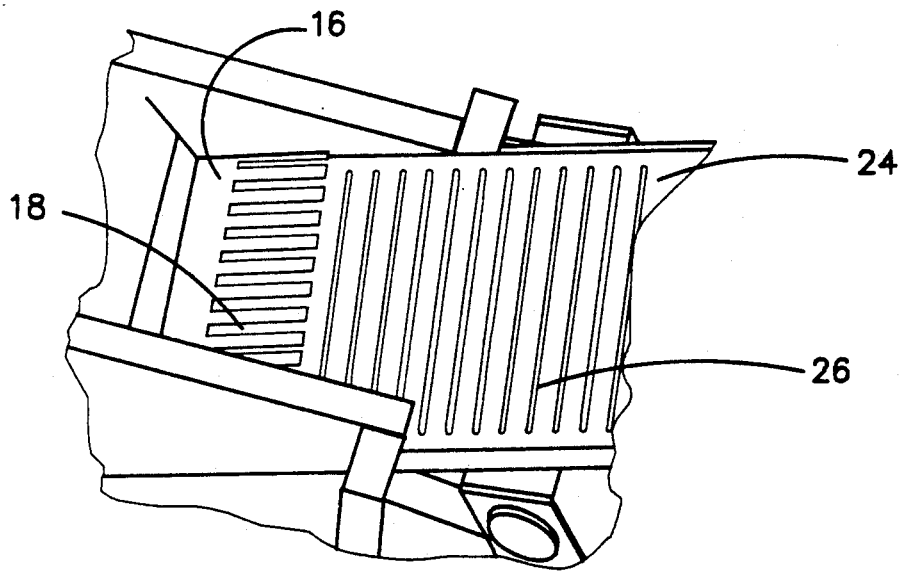
FIG. 5 is a top perspective view of the headbox or forming section of a wet mat forming machine modified in accordance with the embodiment of the present invention illustrated in FIG. 4.

Turning to FIG. 4, there is illustrated another embodiment of the present invention. In this embodiment a second traveling or moving forming belt 24 traveling at the same speed and in the same direction as the continuous traveling forming belt 8 travels through the dewatering section or area 11 of the headbox 2 in contact with the continuous traveling forming belt 8. The moving forming belt 24 functions in a similar manner to the slotted sheet 16 previously discussed. The moving belt 24 as illustrated in FIG. 5 contains a number of slots 26 formed perpendicularly to the line of travel of the continuous traveling forming belts 8 and 24. It should also be noted that the traveling forming belt 24 and the traveling forming belt 8 essentially form one forming belt and could be combined into one belt with slotted depressions therein.

As the continuous traveling forming belt 24 and traveling belt 8 pass through the dewatering area 7 of the headbox 2, the partial or head vacuum applied against the bottom of the continuous traveling forming belt draws the water through the continuous traveling forming belts 8 and 24 and deposits a build up of dispersed fibers 3 onto the top of the continuous traveling forming belt 24, forming a continuous non-woven web of fibers 6. The fibers 3 passing into the slots 26 build up and orient themselves in accordance with the patterns of the slots 26 in the traveling belt 24 aligned in a direction perpendicular to the line of travel of the continuous traveling forming belts 8 and 24 and the fibers 3 passing into the slots 18 build up and orient themselves in accordance with the patterns of the slots 18 in the slotted sheet 16. The continuous non-woven web of fibers 6 is then conveyed to the binder applicator and drying oven and is ready for use.

Figure 6:
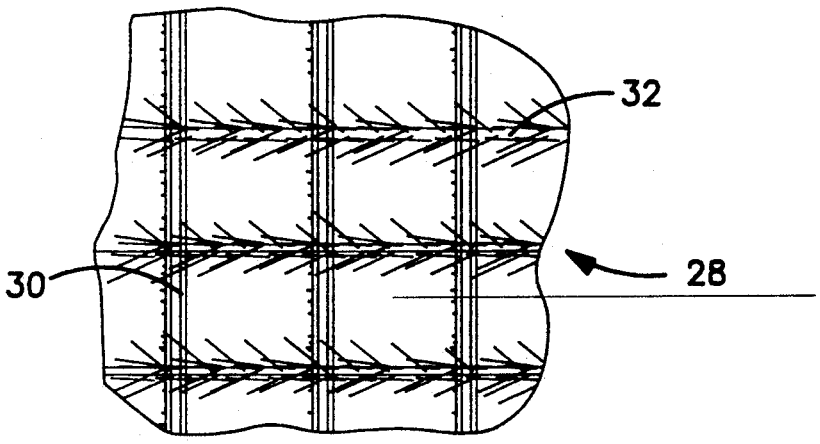
FIG. 6 is a top view of a segment of a non-woven fibrous mat produced in accordance with the embodiment of the present invention illustrated in FIGS. 4 and 5 showing parallel built up lines of fiber reinforcement oriented in the same direction as the direction of travel of the continuous traveling forming belt, and parallel built up lines of fiber reinforcement oriented in a direction perpendicular to the direction of travel of the continuous traveling forming belt.

As shown in FIG. 6 in the fibrous non-woven mat 28 produced by the embodiment of the invention illustrated in FIGS. 4 and 5, parallel built up lines of fiber reinforcement 30 oriented in the same direction as the direction of travel of the continuous traveling forming belt are formed. These built up lines of fiber reinforcement 30 are formed by the action of the slots 18 in the sheet 16. Parallel built up lines of fiber reinforcement 32 oriented in a direction perpendicular to the direction of travel of the continuous traveling forming belt 8 are formed by the slots 26 of the traveling belt 24.

While in the embodiment of the invention illustrated in FIGS. 4 and 5 the traveling forming belt 24 is positioned on top of the forming belt 8 it is recognized that the position of the traveling belts 8 and 24 can be reversed and the web formed on top of the unslotted belt 8.

It should be noted that a non-woven fibrous mat containing parallel reinforcement in the machine direction and cross-machine direction produced from the process described above will have the appearance and strength similar to that obtained by laminating a scrim or continuous sliver or yarn to a preformed non-woven fibrous mat.

While the illustrations have shown parallel built up lines of fiber reinforcement oriented in the same direction as the direction of travel of the forming belt 8 and parallel built up lines of fiber reinforcement oriented in a direction perpendicular to the direction of travel of the forming belt 8, it should be apparent that the invention is not limited to such configurations and various designs may be produced including arced, curved, and other patterns of reinforcement and/or texture using the same technology.

As illustrated in the various embodiments above the portions of the forming belt 8 experiencing a greater flow of water therethrough in the dewatering process will have a greater build up and orientation of fibers deposited thereon.

Figure 7:
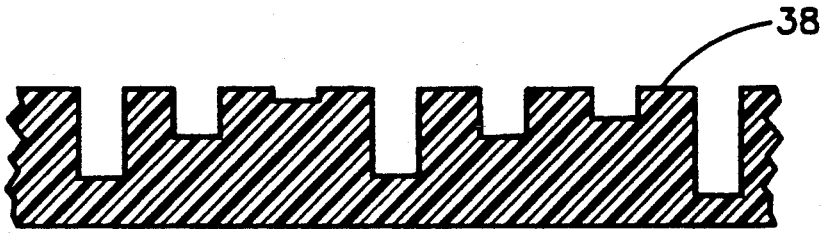
FIG. 7 is a cross-sectional view of a continuous traveling forming belt of a non-woven fibrous wet mat forming machine in accordance with another embodiment of the invention, the cross-section being taken transverse to the direction of travel of the forming belt.
Figure 8:
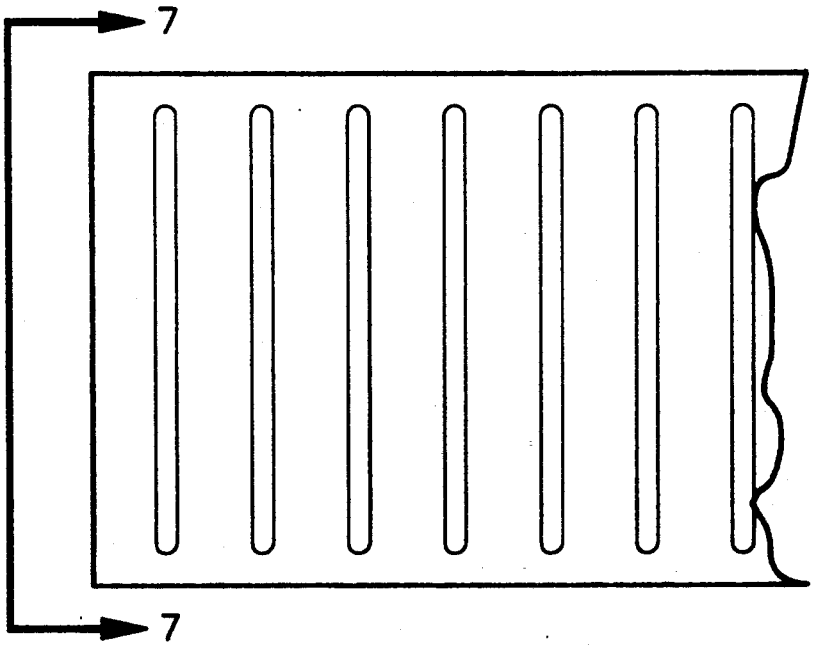
FIG. 8 is a bottom view of the continuous traveling forming belt of a non-woven fibrous wet mat forming machine of the embodiment of the present invention as illustrated in FIG. 7.

In addition to the embodiments shown in FIG. 6 there is illustrated in FIGS. 7 and 8 another embodiment of the invention wherein the desired fiber orientation pattern is designed directly into the forming belt 38 at the time the forming belt 38 is fabricated so that it controls and varies the flow of water through the various segments of the forming belt 38 and thus uses this means to control the deposit and orientation of fibers on the forming belt.

Another embodiment for achieving the results of this invention to control the flow of water through the forming belt, is to make the forming belt of fabric and control the flow of water through the belt by using fabrics with areas of different drainage rates, so that as the non-woven web is formed more material is collected on the areas of the forming fabric where the drainage is greater. Such a forming belt may be constructed by varying the strands per unit length, e.g. fewer strands in areas where greater drainage is needed and more strands elsewhere, or by varying the diameter of the filaments used to construct the fabric in the areas where greater drainage is needed and/or by varying the weave pattern of the forming belt to achieve the desired result.

Other approaches to controlling the flow of the water and thus the amount of fibers deposited on various segments of the forming belt and orienting the fiber in the direction the forming belt travels include adding a restrictor under the forming belt and over the vacuum boxes or source of partial or head vacuum or inserting blocks or other devices to control the differential flow of water through different segments of the forming belt.

From a reading of the foregoing specification and a study of the attached drawings, it should become apparent that many changes in details can be made without departing from the spirit and scope of the invention as expressed in the specification and accompanying drawings and the invention is not to be limited to the exact manner shown and described, as the preferred embodiments have been given by way of illustration only.

What is claimed is:

1. A non-woven fibrous mat of generally random fiber orientation comprising built up strips of discontinuous fiber formed therein adjacent the randomly oriented fibers, the discontinuous fibers of the strips being directionally oriented to enhance the strength or texture of the mat.

2. A non-woven fibrous mat of generally random fiber orientation as defined in claim 1 wherein said built up strips of directionally oriented discontinuous fiber are aligned in parallel relationship with each other.

3. A non-woven fibrous mat of generally random fiber orientation as defined in claim 1 wherein said built up strips of directionally oriented discontinuous fibers form a grid pattern with some of the built up strips of directionally oriented discontinuous fibers oriented substantially perpendicular to others.

4. A non-woven fibrous mat of generally random fiber orientation as defined in claim 1 wherein said built up strips of directionally oriented discontinuous fibers are shaped so as to provide arced and curved reinforcement patterns to enhance the appearance as well as strengthen the mat.

5. A non-woven fibrous mat of generally random fiber orientation as defined in claim 1, wherein the fibers comprise glass fibers.

* * * * *